United States Patent [19]

McKay

[11] 4,210,476

[45] Jul. 1, 1980

[54] METHOD OF MAKING AN INKING RING

[75] Inventor: James G. McKay, Skokie, Ill.

[73] Assignee: Kiwi Coders Corporation, Wheeling, Ill.

[21] Appl. No.: 925,188

[22] Filed: Jul. 17, 1978

Related U.S. Application Data

[60] Division of Ser. No. 800,222, May 25, 1977, Pat. No. 4,126,090, which is a continuation of Ser. No. 669,645, Mar. 23, 1976, abandoned, which is a continuation of Ser. No. 477,654, Jun. 10, 1974, abandoned.

[51] Int. Cl.[2] ..... B41F 31/22

[52] U.S. Cl. ..... 156/112; 29/123; 101/329; 101/348; 156/245; 156/266; 156/293

[58] Field of Search ..... 156/96, 110 R, 112, 156/113, 214, 228, 293, 294, 303.1, 213, 215, 264, 266; 101/328-331, 333, 335, 348-349, 369, 36, 37; 29/123

[56] References Cited

U.S. PATENT DOCUMENTS

| | | | |
|---|---|---|---|
| 1,502,027 | 7/1924 | Fowler | 156/112 |
| 2,006,364 | 7/1935 | Morse | 101/349 |
| 2,459,721 | 1/1949 | Poltorak | 156/214 |
| 2,562,627 | 7/1951 | McKay | 101/367 |
| 2,697,472 | 12/1954 | Hawkinson | 156/96 |
| 2,701,519 | 2/1955 | McKay | 101/35 |
| 2,887,047 | 5/1959 | McKay | 101/329 |
| 2,890,654 | 6/1959 | McKay | 101/367 |
| 3,812,782 | 5/1974 | Funahashi | 101/367 |

*Primary Examiner*—John E. Kittle

*Attorney, Agent, or Firm*—Silverman, Cass & Singer, Ltd.

[57] ABSTRACT

A method of making a resilient expandible inking ring by forming a ring of elastomeric ink-absorbent material of generally rectangular cross-section, seating the ring in a thin wall U-shaped shell of unvulcanized rubber leaving the outer portion of the ring outwardly to extend from the shell introducing a bonding material formed of an uncured rubber slurry between the shell and the ring and vulcanizing the assembly. The ring may be formed by end to end bonding of a strip of said ink-absorbent elastomeric material.

8 Claims, 9 Drawing Figures

24'

METHOD OF MAKING AN INKING RING

This is a division of application Ser. No. 800,222, filed May 25, 1977, now U.S. Pat. No. 4,126,090, which in turn is a continuation application of Ser. No. 669,645, filed Mar. 23, 1976, now abandoned, which in turn is a continuation of Ser. No. 477,654, filed June 10, 1974, now abanoned.

FIELD OF THE INVENTION

This invention relates generally to inking devices for code daters and more particularly provides a rotary inking ring and wheel for a rotatable inking device which has an improved ink capacity, is economical to manufacture and to re-ink and it is capable of being easily and cleanly installed upon presently available rotary inking devices.

In U.S. Pat. Nos. 2,562,627 issued July 31, 1951 and 2,890,654 issued June 16, 1959, there are described rotary inking devices of the general type with which this invention is concerned. These inking devices have great utility in automatic code dating equipment operative in conjunction with a conveyor system for transporting packages past the equipment in a continuous line to have selected indicia applied thereto during such transit. Such inking devices are installed in operative position adjacent the printing wheel to transfer ink to the printing members continuously as the printing device rotates. Other patents illustrating the general type of inking devices with which this invention is concerned are described in U.S. Pat. Nos. 2,887,047 and 2,701,519 as well as others issued to the present Applicant.

In many devices of this general character it has been desirable to provide an inking ring of some type of material which is absorbent, which can be pre-inked and which ring is capable of being mounted upon a hub. The intention, of course, is to provide a disposable inking ring. Such a disposable ring has much advantage, but its principal characteristic of disposability is a disadvantage in most usage in that it cannot be re-inked once depleted. Presently available pre-inked rings are very short-lived and the handling of some is messy. It would be desirable to permit the advantages of a pre-inked member but provide one which is capable of easily loading with ink, clean handling and further which does not permit the ink to be extruded other than at its exposed surface instead of, for example, oozing around the side portions or soaking ink into the wheel. Among other advantages, the availability of an inking ring which could easily and cleanly be removed and replaced from the inking wheel would assure materially reduced downtime of the coding apparatus now required to effect replacement of the exhausted absorbent member of the inking wheel. In addition, the manufacturer and/or user could carry a stock of rings of many different widths instead of being required to carry assembled stocks of inking wheels, as is the present experience. Manufacture of the ink-absorbent members for inking wheels is facilitated with machining steps not required.

SUMMARY OF THE INVENTION

An inking ring and wheel for code daters comprising a ring of absorbent material seated in a thin wall shell, with a relatively small portion of the ring extending radially outwardly of the shell. The shell is a thin walled U-shaped member which is permanently adhered to the ring and is formed of ink impervious material.

DESCRIPTION OF THE PREFERRED EMBODIMENTS

Figure 1:
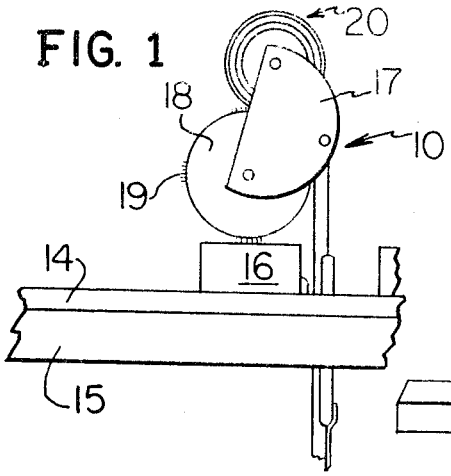
FIG. 1 is an elevational view of a typical code dater device having the inking ring and wheel constructed in accordance with the invention installed as a part thereof, portions being deleted to show interior construction.
Figure 4:
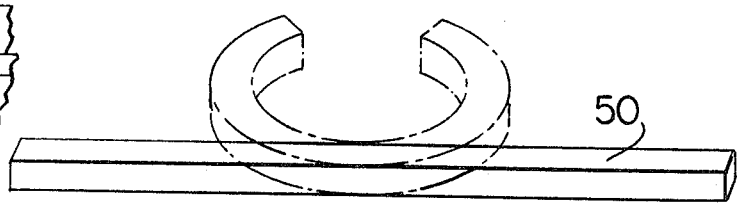
FIGS. 4 to 9 are diagrammatic representations showing progressively a method employed in the fabrication of the inking ring according to the invention.

Referring to the drawing, a representative code dating apparatus designated generally by the reference character 10 is installed in conjunction with a conveyor table 12, the movable reach or table top 14 of the conveyor transporting individual packages or containers in a continously moving line past the apparatus 10 to have imparted thereon selected codifying indicia, such a container 16 being shown passing in printing relation with said apparatus to receive an imprint. For this purpose, the apparatus 10 includes a printing wheel 18 rotatably mounted between a pair of support plates which is shown at 17. The printing wheel 18 is rotated to apply the imprint upon engagement therewith of the moving package 16. The printing wheel 18 carries a plurality of printing members 19 or other printing means such as rubber or metal type members to engage the packages. Spaced above the printing wheel 18 is an inking wheel embodying the invention which has been designated generally by the reference character 20.

It should be understood that the apparatus 10 is illustrative to show the environment in which the inking wheel 20 is suitable for operation and is not intended to restrict the application of the principles of this invention merely to such apparatus. The represented apparatus, however, is sufficient to instruct in the relationship between the printing wheel 18 and the inking wheel 20, it being noted that the inking device is supported between plates for rotation on an axis parallel with and spaced from the axis of rotation of the printing wheel and the periphery of the inking wheel is arranged to contact the protruding type members so as to transfer ink to the type as the printing wheel rotates.

The inking wheel 20 comprises a hub 22 along the rim of which is mounted the inking ring 24. A pair of side plates 23 secured to the hub are retained on opposite sides of ring 24. The inking ring 24 comprises an annular band 26 of ink-absorbent material such as foam rubber. The band 26 is seated within unitary shell 28, the shell 28 being defined by the floor 30 and a pair of opposite side walls 32. The shell is formed of ink-impervious material, such as, for example, unvulcanized rubber. The shell walls defined by the floor 30 and side walls 32 are thin. The band 26 is seated within the shell 28 so that the rim or outer perpherial portion 34 thereof extends outward from the shell from about one-eighth to three-eighths inch. The outer circumferential surface 27 of the ring 24 at least is porous, that is without any residual skin sometimes encountered as a result of manufacturing process for foam rubber strip. The band 26 is permanently secured within the shell 28 so as to form an integral unit. Preferably an adhesive 36 such as a slurry of unvulcanized (uncured) rubber is utilized to effect the permanent adherence of the band within the shell. Preferably, the unvulcanized rubber slurry is formed using a solvent such as Methyl Ethel Ketone, such slurry being a liquid mixture at room temperature. The inking ring 24 is loaded with ink after assembly to form the inking wheel. Loading may be performed by simply rolling the wheel several times upon a tray carrying an ink layer thus forcing ink onto the porous member. The ink loads the porous member generally to the extent of perhaps one-fourth inch to three-eighths inch and the thus loaded wheel can be used several months instead of the one or two days maximum expected life of the available disposable inking rings.

The ring 24 is simply slipped onto the hub disc 22, which has an axial mounting passage 38. The circular plates 23 are arranged on opposite sides of the disc 22. A threaded hollow sleeve 40 is passed through the passage 38 and a pair of hex nuts 42 threadably are engaged on the sleeve 40. A shaft 44 having threaded ends is passed through the sleeve and a pair of hex nuts 46 are mounted at opposite ends of the shaft 44 and cap nuts 48 finish off the assembly. The wheel 20 is freely rotatable on sleeve 40 when assembled.

Figure 5:
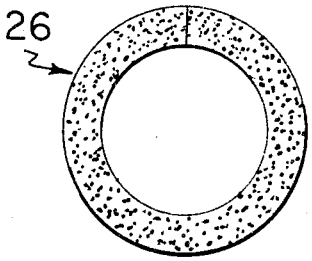
Figure 6:
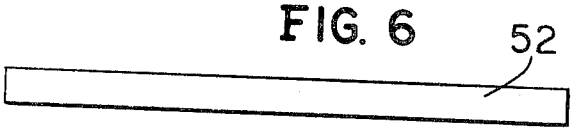
Figure 7:
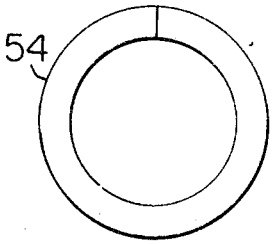
Figure 8:
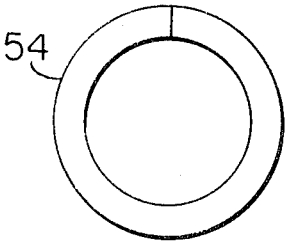
Figure 2:
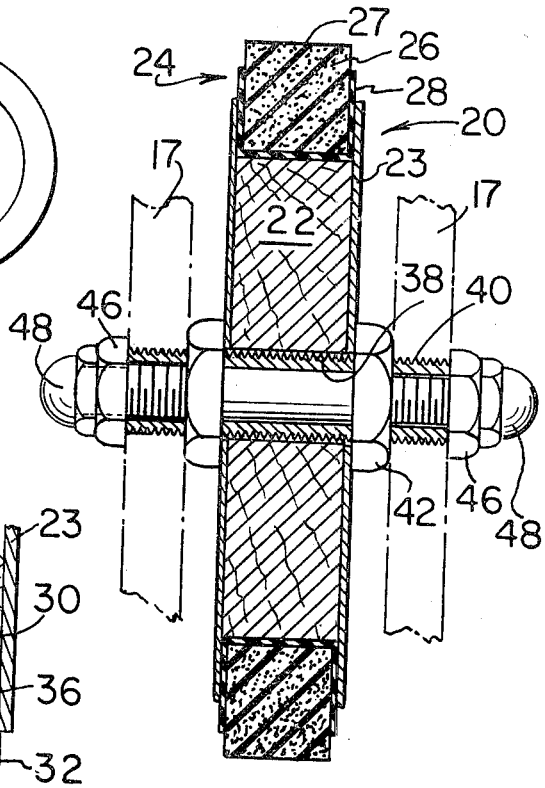
FIG. 2 is an enlarged sectional view taken along lines 2—2 of FIG. 1 and viewed in the direction indicated.
Figure 9:
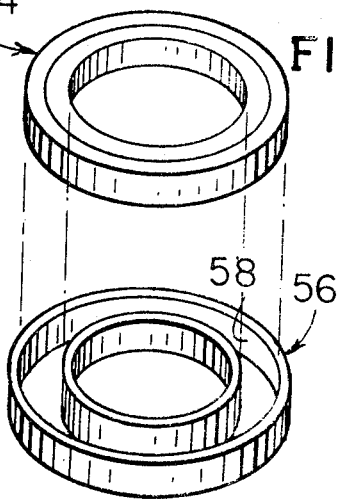
Figure 3:
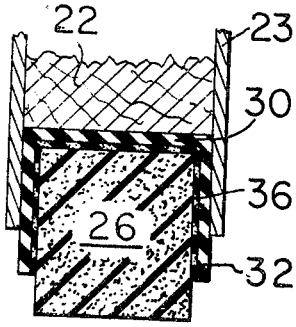
FIG. 3 is a further enlarged fragmentary detail of the inking ring and wheel of FIG. 2.

Referring to FIGS. 4–9, there is diagrammatically stepwise illustrated one method utilized to construct the inking ring 20 of the invention. A flat, generally rectangular cross-section strip 50 of foam rubber is cut to the desired length so that when it is joined end-to-end as shown in phantom view in FIG. 4, the inner diameter of the thus formed ring will approximate the outer diameter of the hub 26 which preferably is a wooden or plastic disc, upon which it is to be mounted. In the embodiment described, the disc has a diameter of three and one-half inches. A slurry of Methyl Ethel Ketone and uncured rubber is formed and used as an adhesive which is applied to the ends of the strip so as to hold the same together, as shown in FIG. 5.

A thin, flat strip 52 of 0.010′ thickness unvulcanized rubber is formed of a length sufficient for placement along the inner circumference of the ring defined by the end-to-end connected foam rubber strip, with or without overlap. A pair of circular strips 54 of like-thickness unvulcanized rubber is formed and applied to define the side walls of the shell 28. The strips 54 defining the side walls 32 of the shell 28 are lesser in width than the thickness of the strip of foam rubber so that the outer peripheral portion 34 of the foam rubber extends outwardly of the shell 28. The edges 53 need not be regular, that is even, but the inner diameter of the strips 52 should be regular and closely approximate the outer diameter of the disc 26. The strips of unvulcanized rubber are coated with the slurry and placed in a mold 56 with the band 26, the assembled inking ring 24′ being shown in FIG. 9. Curing or vulcanization of the slurry and unvulcanized rubber strip is effected with the ring within the mold. Heating of the mold 56 with the assembled ring 24′ unit therein at a temperature of 309° F. for a duration of 9 minutes provided a satisfactory inking ring.

Other more sophisticated methods of manufacture are contemplated where the shell can be a thin walled extruded member with the side walls and floor unitary. Such method of manufacture could involve coating the interior of the thus formed shell with the slurry and seating the foam rubber band therein with the ends thereof coated with an adhesive and adhered together.

The mold 56 may comprise a brass ring mold with or without a floor. As an example, brass ring mold having an outer wall and an inner wall is used. The wall height is 0.500″, the inner diameter is 4.438″ and the wall thickness is 0.062″. The inner ring is of the same height and thickness, but has a 3.438″ outer diameter so that the channel defined therebetween has a width of one-half inch, providing a stretch factor, or the hub 26, of about 1/16th inch. The strip of foam rubber cross section selected is one-half inch square. For many purposes wider strips are desirable and in fact may be stepwise up to six inches or more, the height of the rings being selected accordingly. The flat unvulcanized rubber strips are formed and cut to size; one of said strips 54 can be placed as a floor lining in the mold should a floor be used. Strip 52 is arranged against the inner wall 58 of mold 56. The said strips are coated with the liquid slurry of unvulcanized rubber. The foam rubber strip ends are coated, joined and inserted in the coated lined mold. The second strip 54 is laid over the strip 54 so as to complete the shell 28. Preferably, the mold and its contents are placed sandwiched between a pair of heat conductive plates (not shown) and heated to a temperature sufficient to vulcanize the unvulcanized rubber. The vulcanizing process is continued sufficient to achieve a rubber durometer measurement after vulcanizing of from 35 to 40. The finished assembly then is removed from the mold in due course. Of course, if the unvulcanized rubber is of the type which is room temperature vulcanizable, heating may not be required.

Preferably the dimensions are selected so that the finished inking ring must be stretched slightly for application to the hub. Of key advantage is the ease of removal of the inking ring from the hub and inking assembly—merely involving slipping one off and a fresh one upon the hub. This can be accomplished without getting ink all over the fingers or other deleterious effects. The rings can be mounted side by side on a wide hub to provide many different width inking surfaces.

What it is desired to secure by Letters Patent of the United States is:

1. A method of manufacturing an inking ring comprising the steps of forming an annular band of ink-absorbent material, forming a thin walled annular shell having a floor and side walls formed of ink-impervious vulcanizable thin sheet material, seating said band within the interior of said formed shell to expose the peripheral portion of the said band radially outward of said shell, applying a vulcanizable adhesive material within said shell interior before seating said band therewithin and vulcanizing such assembly simultaneously forming a unitary body.

2. The method of manufacturing an inking ring as claimed in claim 1 in which the vulcanizable adhesive material is applied between the band and the shell.

3. The method of manufacturing an inking ring as claimed in claim 1 in which the shell is formed of thin strips of unvulcanized rubber by laying same as a lining within a mold, the strip of ink-absorbent material is cut to desired length and the adhesive is coated as a liquid slurry of unvulcanized rubber upon said lining and between the ends of said absorbent strip, inserting the absorbent strip into the mold arranged end to end and vulcanizing the assembly.

4. The method as claimed in claim 2 in which the adhesive is a liquid slurry of unvulcanized rubber and the assembly is vulcanized within a mold.

5. A method of making a resilient expandible inking ring comprising the steps of forming an annular generally rectangular cross-section closed ring having parallel side walls of cellular, resilient, flexible elastomeric material which is capable of carrying ink applied thereto in interstices for transfer to a surface contacted thereby, forming a channel shaped cross-section thin walled shell of unvulcanized rubber sheet which is ink-impervious, applying between the ring and shell a thin bonding layer as a liquid slurry of unvulcanized rubber, seating the ring within the shell so that the radially outer portions of the walls of the ring and its outer circumferential surface extend outward from the shell free from the applied bonding layer and simultaneously vulcanizing the assembled ring, shell and bonding layer to their cured state.

6. The method as claimed in claim 5 wherein the ring is formed by return bending a length of said cellular material having a rectangular cross-section and opposite end walls to substantially a ring configuration and applying an aqueous slurry of unvulcanized rubber to the opposite ends of the band and engaging said ends to complete the ring.

7. The method as claimed in claim 6 in which the shell is formed from the strips of unvulcanized sheet rubber including annular flat strips cut to ring-like configuration and a flat strip, the ring-like strips applied to the annular sides of the ring and the flat strip applied to the ring along the inner circumference thereof, the slurry being introduced between said strips and band and the assembly then vulcanized.

8. The method as claimed in claim 7 in which the shell is formed of thin strips of unvulcanized rubber by laying same as a lining within a mold, the strip of ink-absorbent material is cut to desired length and coating a liquid slurry of unvulcanized rubber upon said lining and the ends of said absorbent strip, inserting the absorbent strip into the mold arranged end to end and vulcanizing the assembly.

* * * * *